US008601756B2

(12) United States Patent
McNamee

(10) Patent No.: US 8,601,756 B2
(45) Date of Patent: Dec. 10, 2013

(54) INTERLOCKING RAIL SYSTEM

(76) Inventor: Steve V. McNamee, Argusville, ND (US)

( * ) Notice: Subject to any disclaimer, the term of this patent is extended or adjusted under 35 U.S.C. 154(b) by 672 days.

(21) Appl. No.: 12/712,878

(22) Filed: Feb. 25, 2010

(65) Prior Publication Data

US 2011/0203215 A1 Aug. 25, 2011

(51) Int. Cl.
*E04F 11/16* (2006.01)
*E04F 15/00* (2006.01)

(52) U.S. Cl.
USPC ..... 52/177

(58) Field of Classification Search
USPC ..... 52/650.3, 177, 656.1, 653.1
See application file for complete search history.

(56) References Cited

U.S. PATENT DOCUMENTS

| | | | | |
|---|---|---|---|---|
| 5,323,903 | A * | 6/1994 | Bush et al. | 206/386 |
| 6,237,299 | B1 * | 5/2001 | Gortan | 52/693 |
| 6,872,434 | B2 * | 3/2005 | Zen | 428/36.9 |
| 2002/0194795 | A1 * | 12/2002 | Spite | 52/79.1 |
| 2006/0185312 | A1 * | 8/2006 | Weeks | 52/653.1 |

* cited by examiner

*Primary Examiner* — Mark Wendell
*Assistant Examiner* — Keith Minter
(74) *Attorney, Agent, or Firm* — Theodore M. Magee; Westman, Champlin & Koehler, P.A.

(57) ABSTRACT

A platform system includes a platform frame having a header defining a first channel. Decking is mounted to the platform frame. A post is attached to a mounting member, which defines a second channel. The mounting member and the header form an interlock coupling where a portion of the mounting member resides in the first channel and a portion of the header resides in the second channel. A locking pin is positioned within a recess that is partially defined by the header and that is partially defined by the mounting member to limit movement of the mounting member relative to the header.

18 Claims, 8 Drawing Sheets

INTERLOCKING RAIL SYSTEM

BACKGROUND

Decking systems consist of a frame mounted to the exterior of a building with some type of decking material mounted on top of the frame. For safety, railings are placed around the outside perimeter of the deck.

Currently, the railings are bolted to the frame. In some systems, the railings are attached to a mounting piece that is then bolted to the frame by aligning holes in the frame with holes in the mounting piece. Because of the weight of the railings and the fact that the deck may be positioned high above the ground during assembly, aligning the holes of the mounting piece with the holes of the frame is time consuming and labor intensive.

The discussion above is merely provided for general background information and is not intended to be used as an aid in determining the scope of the claimed subject matter.

SUMMARY

A platform system includes a platform frame having a header defining a first channel. Decking is mounted to the platform frame. A post is attached to a mounting member, which defines a second channel. The mounting member and the header form an interlock coupling where a portion of the mounting member resides in the first channel and a portion of the header resides in the second channel. A locking pin is positioned within a recess that is partially defined by the header and that is partially defined by the mounting member to limit movement of the mounting member relative to the header.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A platform system is provided in which a railing subassembly is attached to a frame of the platform system using two interlock couplings and a locking mechanism. The interlock couplings allow the railing system to be mounted to the frame by sliding tongues of the railing system into channels in a header of the frame in a top down manner. The interlock coupling supports the weight of the railing subassembly and prevents the top of the railing subassembly from pivoting. The locking mechanism prevents the railing subassembly from being lifted relative to the header frame after installation.

Figure 1:
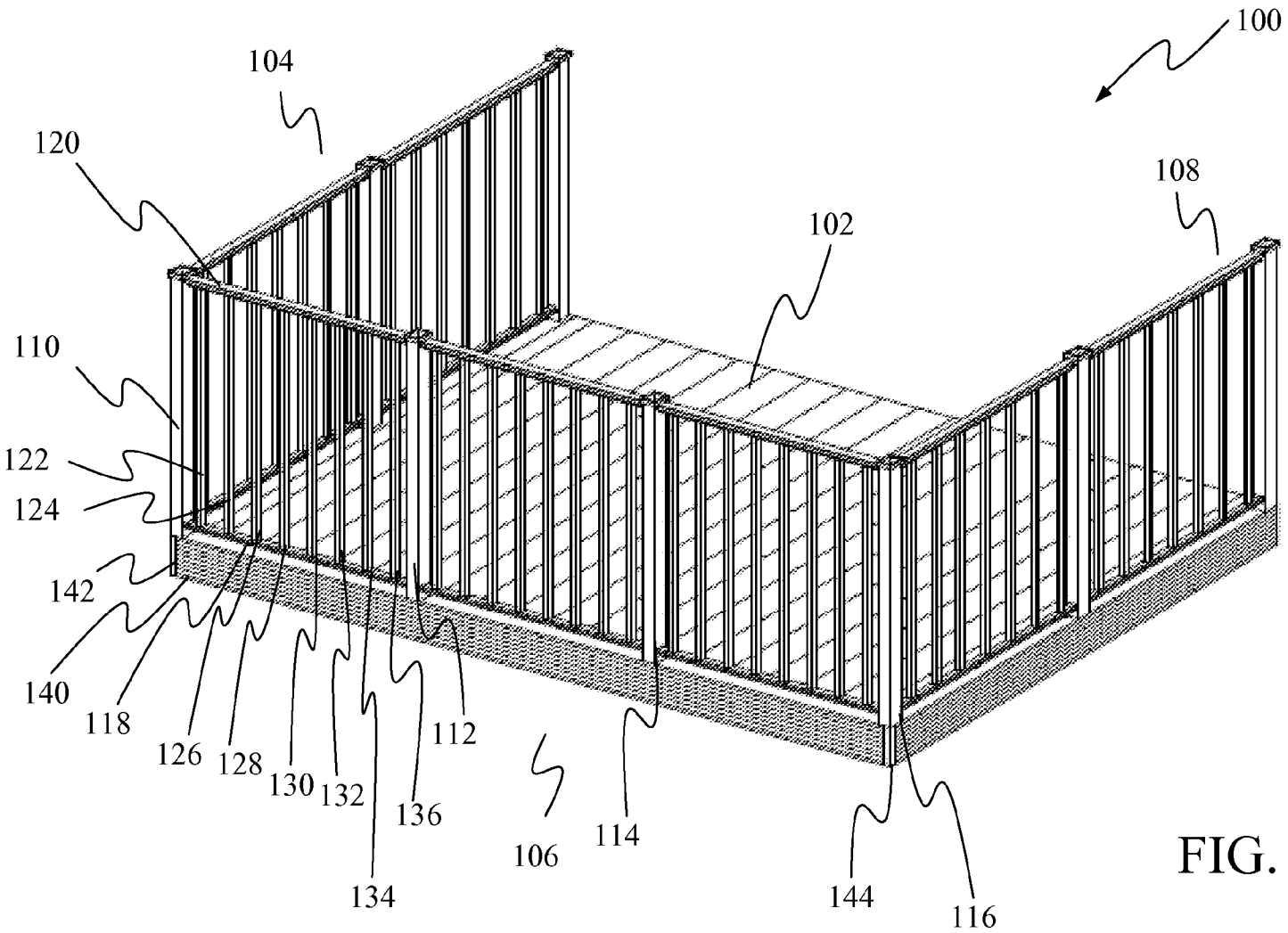
FIG. 1 is a perspective view of a platform system under one embodiment.

FIG. 1 provides a perspective view of a platform system 100 under one embodiment of the present invention showing decking 102, and railing subassemblies (also referred to as railing systems) 104, 106 and 108. Railing subassembly 106 includes posts 110, 112, 114 and 116 and a bottom rail 118 that is attached to each post. Railing subassembly 106 also includes stiles such as stiles 122, 124, 126, 128, 130, 132, 134, and 136 that are connected between bottom rail 118 and a top rail 120. A skirt 140 is attached to the exterior of posts 110, 112, 114 and 116 and two corner brackets 142 and 144 are connected to the exterior of skirt 140. A frame supports decking 102 and railing subassemblies 104, 106 and 108 but is not visible in FIG. 1.

Figure 2:
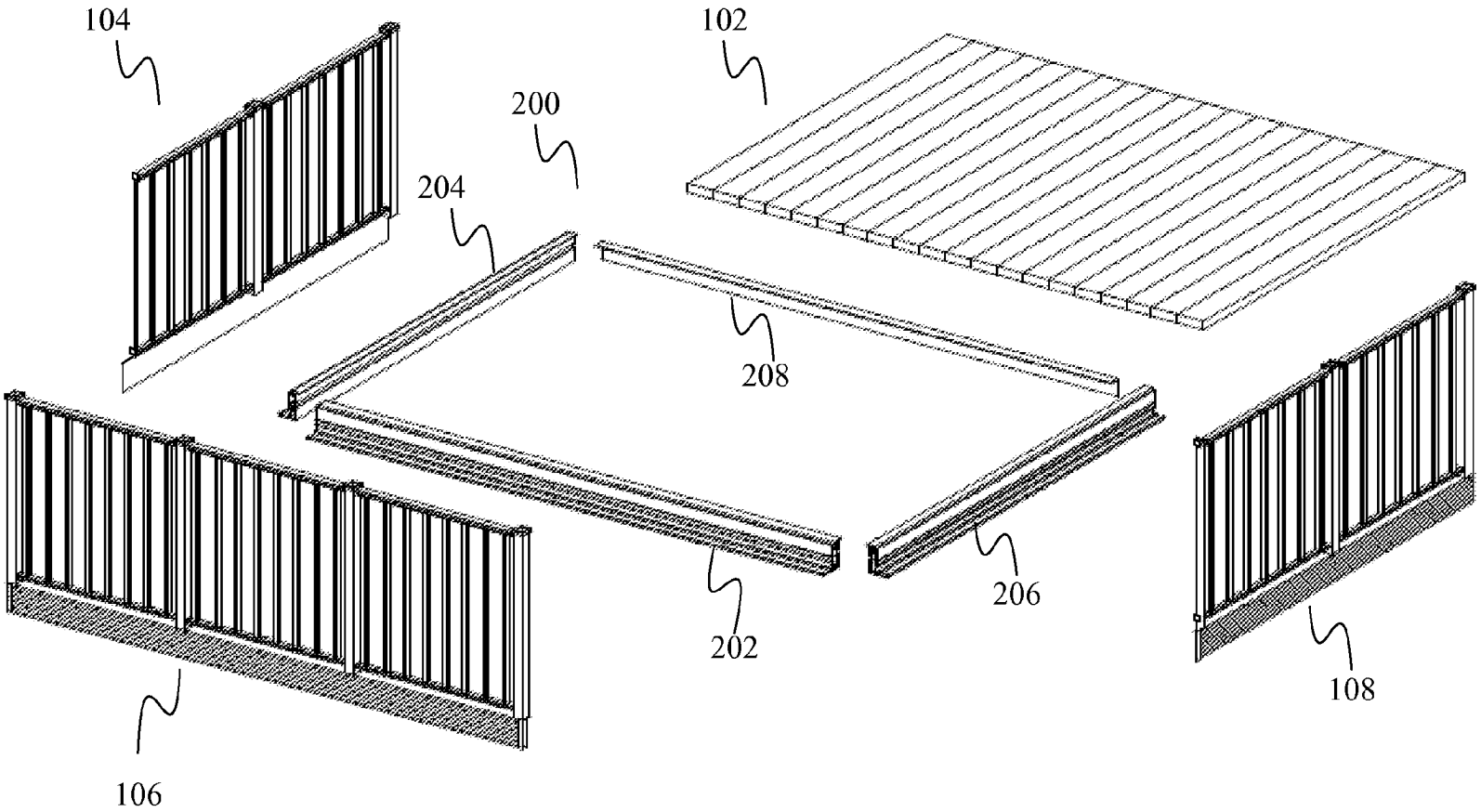
FIG. 2 is an exploded view of the platform system of FIG. 1.

FIG. 2 provides an exploded view of the platform system 100 of FIG. 1 showing a platform frame 200 that supports decking 102 and railing subassemblies 104, 106 and 108. Platform frame 200 includes headers 202, 204 and 206, and mounting beam 208.

Under one embodiment, platform system 100 is made of extruded aluminum. In other embodiments, other materials are used.

Figure 3:
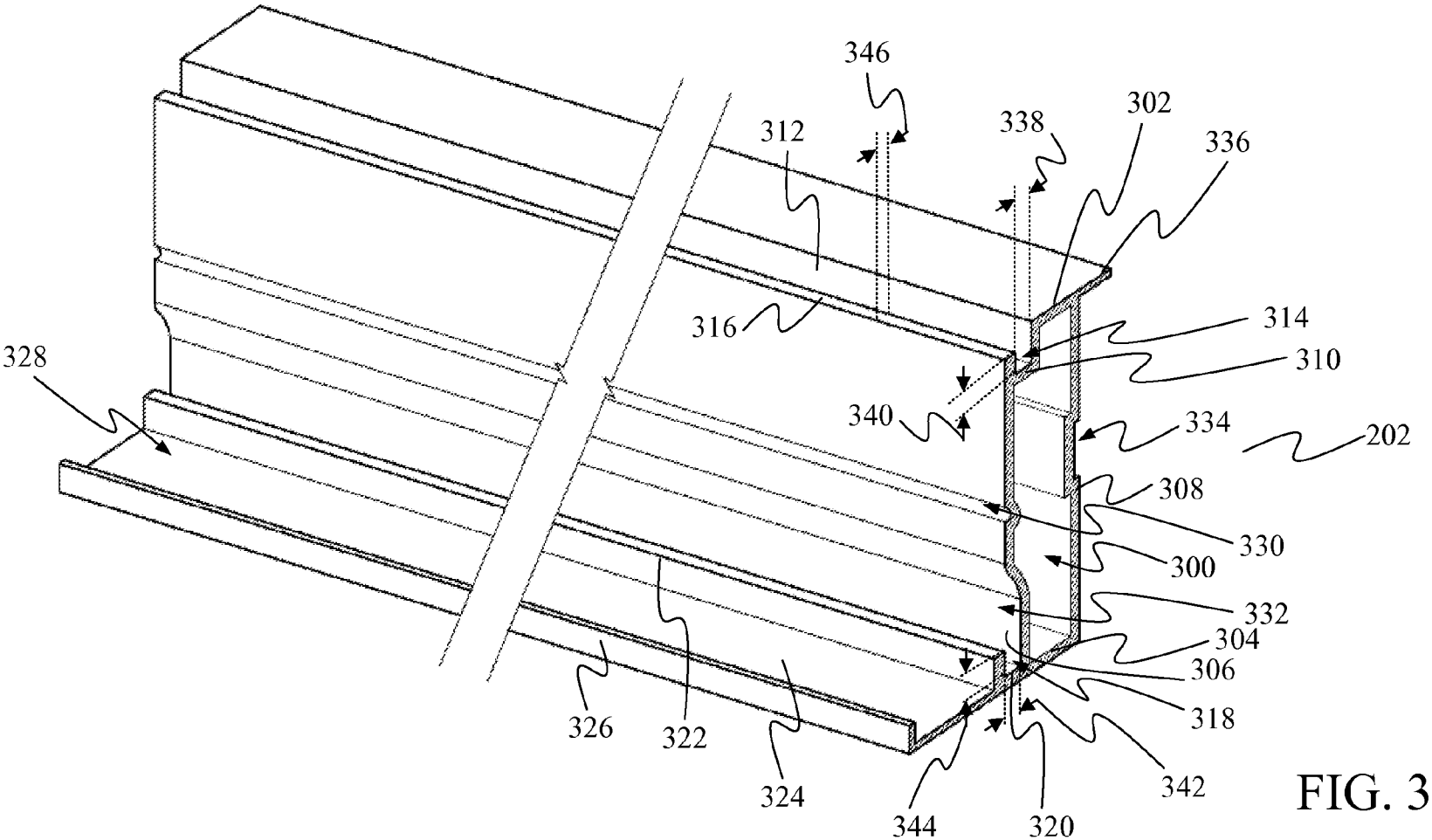
FIG. 3 is a perspective view of a frame header under one embodiment.

FIG. 3 provides a perspective view of a portion of header 202 of FIG. 2. Header 202 includes a hollow chamber 300 defined by top wall 302, a bottom wall 304, an exterior-facing wall 306, an interior-facing wall 308, a channel bottom 310, and a channel wall 312. Header 202 also includes a channel 314 defined by channel wall 302, channel bottom 310 and a tongue 316. Header 202 also includes a second channel 318 defined by exterior-facing wall 306, a channel bottom 320 and a tongue 322. A bottom arm 324 extends from the base of tongue 322 and ends with an upwardly extending lip 326 to define a channel 328. In one embodiment, bottom arm 324 is aligned with bottom wall 304.

Exterior-facing wall 306 and interior-facing wall 308 extend upward from bottom wall 304. Channel bottom 310 extends laterally toward interior-facing wall 308 from exterior-facing wall 306. Channel wall 312 extends upwardly from channel bottom 310 and ends at top wall 302. Top wall 302 extends over and past interior-facing wall 308 to define a decking holding member 336, under which decking 102 is secured.

Exterior-facing wall 308 is shaped to define a recess 330 and a recess 332. The portion of exterior-facing wall 308 that defines recess 332 also defines channel 318. Interior-facing wall 308 is shaped to define a recess 334.

Under one embodiment, channel 314 has a width 338 of ⅜ inch as measured between channel wall 312 and tongue 316 and a height 340 of ⅜ inch as measured from the bottom of channel 314 to the top of tongue 316. Similarly, channel 318 has a width 342 of ⅜ inch as measured between exterior facing wall 306 and tongue 322 and a height 344 of ⅜ inch as measured from the bottom of channel 306 to the top of tongue 310. Tongue 316 has a width 346 of ¼ inch.

Figure 4:
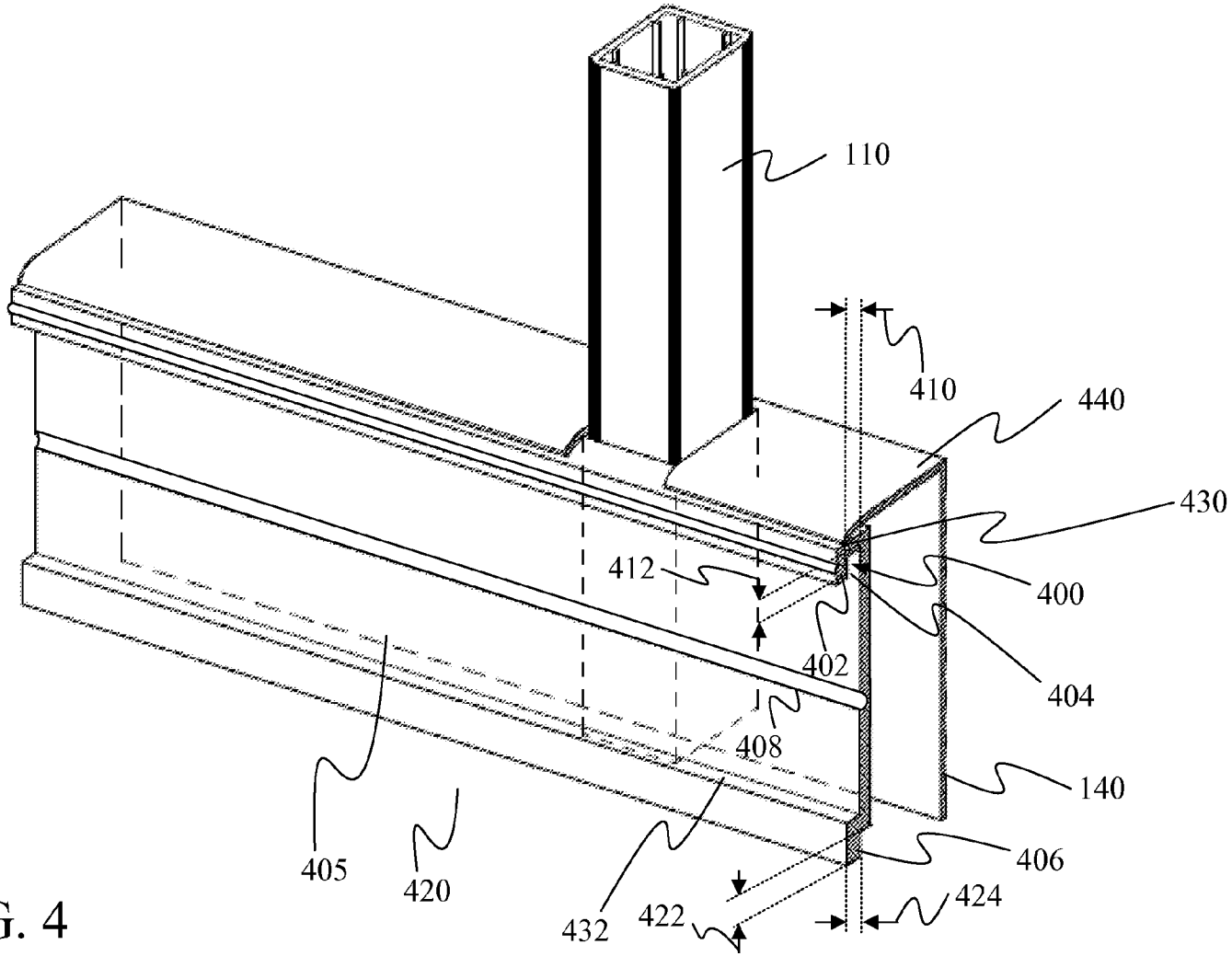
FIG. 4 is a perspective view of a lower portion of a railing system under one embodiment.

FIG. 4 shows a perspective view of the lower portion of a segment of rail subassembly 106. The portion of subassembly 106 shown in FIG. 4 includes a mounting member 420 attached to post 112. Under one embodiment, mounting member 420 is attached to post 110 through welds along a base portion 405 of mounting member 420. Skirt 140 is also attached to post 110 using welds.

Mounting member 420 includes a channel 400 that is defined by a tongue 402, a lateral extension 430 and a wall 404 of base portion 405. Under one embodiment, channel 400 has a width 410 of 5/16 inch measured between tongue 402 and wall 404 and a height 412 of 3/8 inch measured from the interior surface of lateral extension 430 to the end of tongue 402. Mounting member 420 includes a second tongue 406 that has a height 422 of 3/8 inch measured from the end of second tongue 406 to the bottom of a lateral extension 432 and a width 424 of 5/16 inch. Although second tongue 406 is shown as extending from lateral extension 432, which extends from the bottom of wall 404, in other embodiments, lateral extension 432 is not present and tongue 406 is aligned with wall 404. Mounting member 420 also includes a recess 408 in base portion 405 that in most embodiments runs parallel to channel 400.

The top of skirt 140 is bent to form a cap 440 that extends along the sides of post 110 and over lateral extension 430. The end of cap 440 is bent down toward the top of lateral extension 430.

Figure 5:
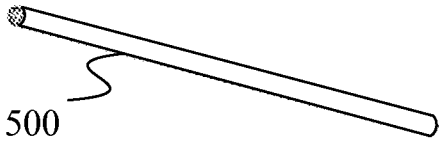
FIG. 5 is a perspective view of a locking pin under one embodiment.

FIG. 5 provides a perspective view of a locking mechanism 500, which under one embodiment is a pin or dowel, that is inserted in a recess defined by recess 408 and recess 330 when header 202 and mounting member 420 are interlocked together.

Figure 6:
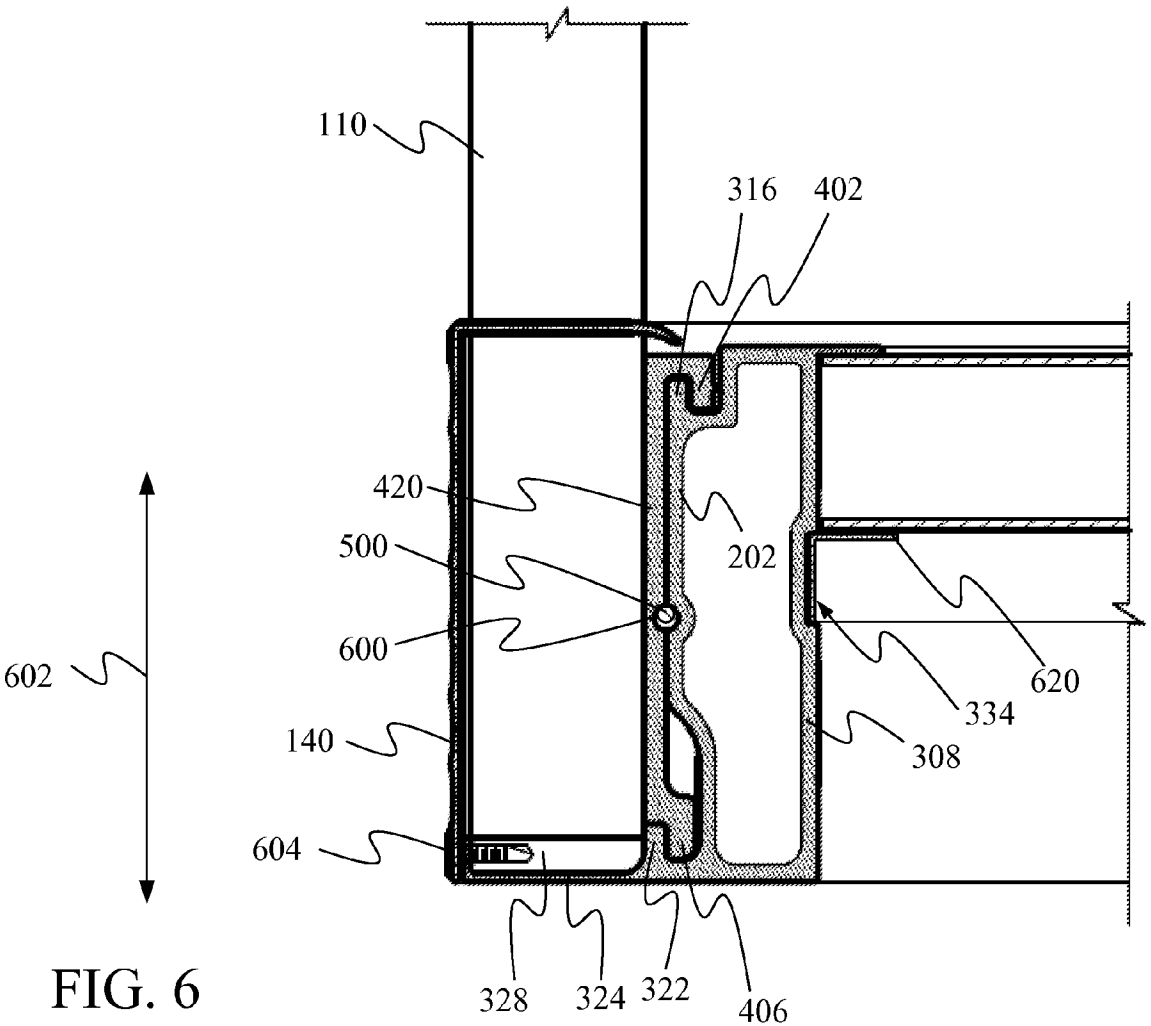
FIG. 6 is a side view of a frame header connected to a railing system using an interlocking coupling under one embodiment.

FIG. 6 provides a side view of header 202 and railing subassembly 106 interlocked together. In FIG. 6, tongue 402 of mounting member 420 is placed in channel 314 of header 202 and tongue 316 of header 202 is placed in channel 400 of mounting member 420. In one embodiment, the heights of channels 314 and 400 match such that the respective tongues in each channel contact the bottom of the channel. This configuration forms an interlock coupling between mounting member 420 and header 202. In addition, tongue 406 of mounting member 420 is placed in channel 318 of header 202. This forms a second interlock coupling. Under one embodiment, the height of tongue 406 matches the height of channel 318 such that the end of tongue 406 contacts channel bottom 320.

The interlock couplings formed by header 202 and mounting member 420 support the weight of railing subassembly 106 and prevent railing subassembly 106 from pivoting about an axis parallel to header 202. Thus, if an inward or outward force is applied to top rail 120 of railing subassembly 106 after mounting member 420 has been interlocked with header 202, the interlock coupling will inhibit movement of rail subassembly 106.

In FIG. 6, locking pin 500 has been inserted into a recess 600 that is partially defined along the length of pin 500 by recess 408 of mounting member 420 and is partially defined along the length of pin 500 by recess 330 of header 202. When positioned in recess 600, locking pin 500 inhibits mounting member 420 from moving vertically relative to header 202, where vertical movement is defined along an axis 602 that is perpendicular to the axis of recess 600. Although recess 600 and locking pin 500 are shown as being circular, other shapes may be used such as rectangular or square for example.

In FIG. 6, skirt 140 is connected to lip 326 of header 202 by a screw 604. The attachment of skirt 140 to lip 314 is optional.

As shown in FIG. 6, arm 324 extends below post 110 and the top of lip 326 contacts the bottom of post 110. The extension of arm 324 below post 110 provides a more solid look to the combination of railing subassembly 106 and header 202 when viewed from below since it gives the appearance of a single element instead of showing mounting member 420 and post 110. In addition, channel 328 formed by arm 324 provides a water run-off channel such that water from decking 102 that passes beneath cap 440 is channeled laterally along channel 328.

In FIG. 6 decking 102 is shown positioned between decking holding member 336 and angle support 620, which is mounted within channel 334 of interior-facing wall 308 by a screw or weld(not shown) Decking 102 may also be attached to angle support 620 with a screw or weld.

Figure 7:
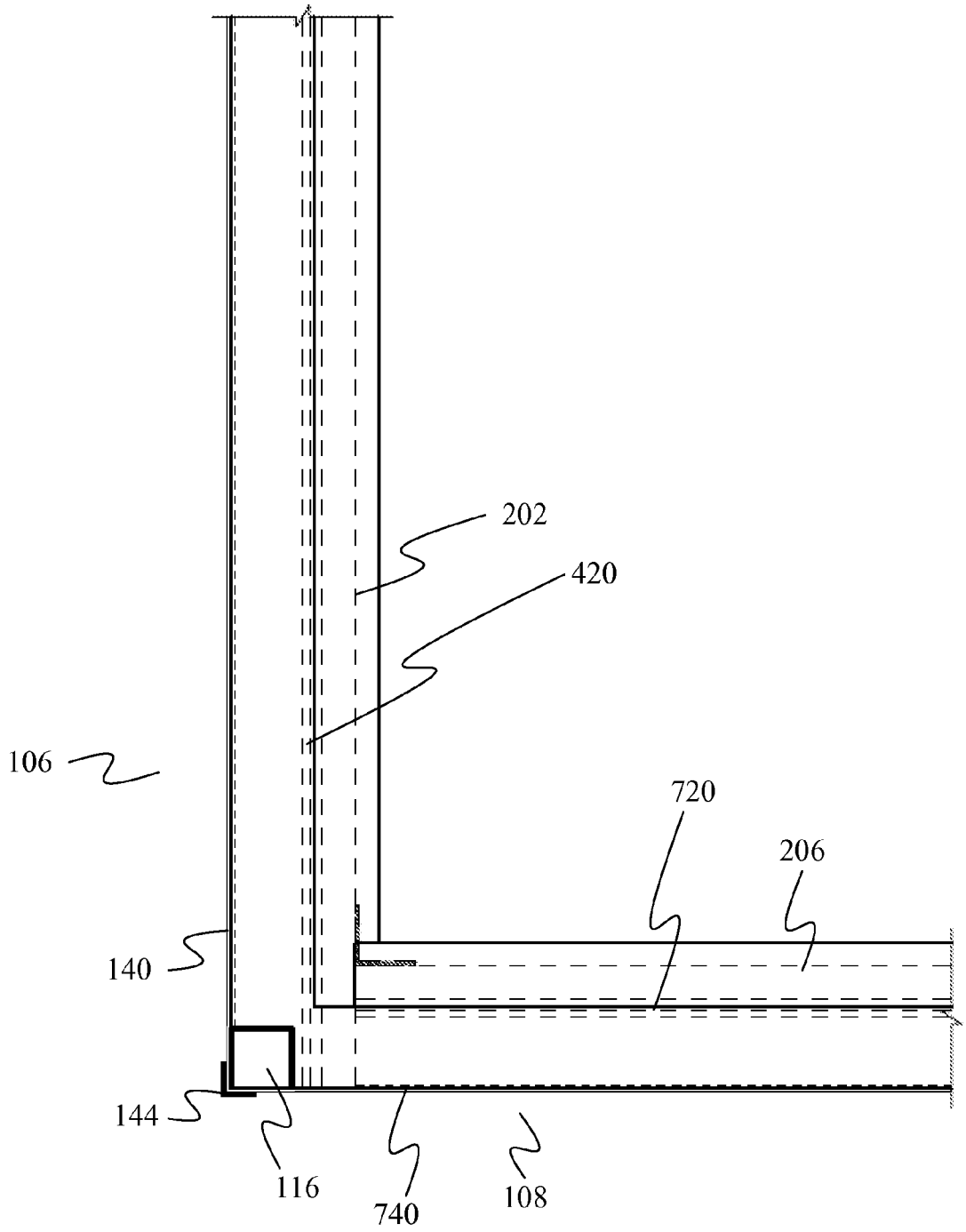
FIG. 7 is a partial top view of a corner of a platform system without decking under one embodiment.

FIG. 7 shows a partial top cross-sectional view of platform system 100 with decking 102 removed showing railing subassemblies 106 and 108 and headers 202 and 206. In FIG. 7, skirt 140 is attached to post 116 in railing subassembly 106 as shown in FIG. 1. A corner bracket 144 is attached to skirt 140 by welding corner bracket 144 to skirt 140, for example. A skirt 740 of railing subassembly 108 is frictionally fit within a space defined between corner bracket 144 and post 116. Corner bracket 144 and skirt 740 inhibit lateral shifting of railing subassemblies 106 and 108.

Railing subassembly 108 includes a mounting member 720 that has the same cross-sectional shape as mounting member 420. Mounting member 720 is interlocked with header 206, which has the same cross-sectional shape as header 202. When interlocked, mounting member 720 and header 206 have the same relationship to each other as mounting member 420 and header 202 have in FIG. 6. A locking pin (not shown) is also provided within a recess that is partially defined by mounting member 720 and that is partially defined by header 206.

Figure 8:
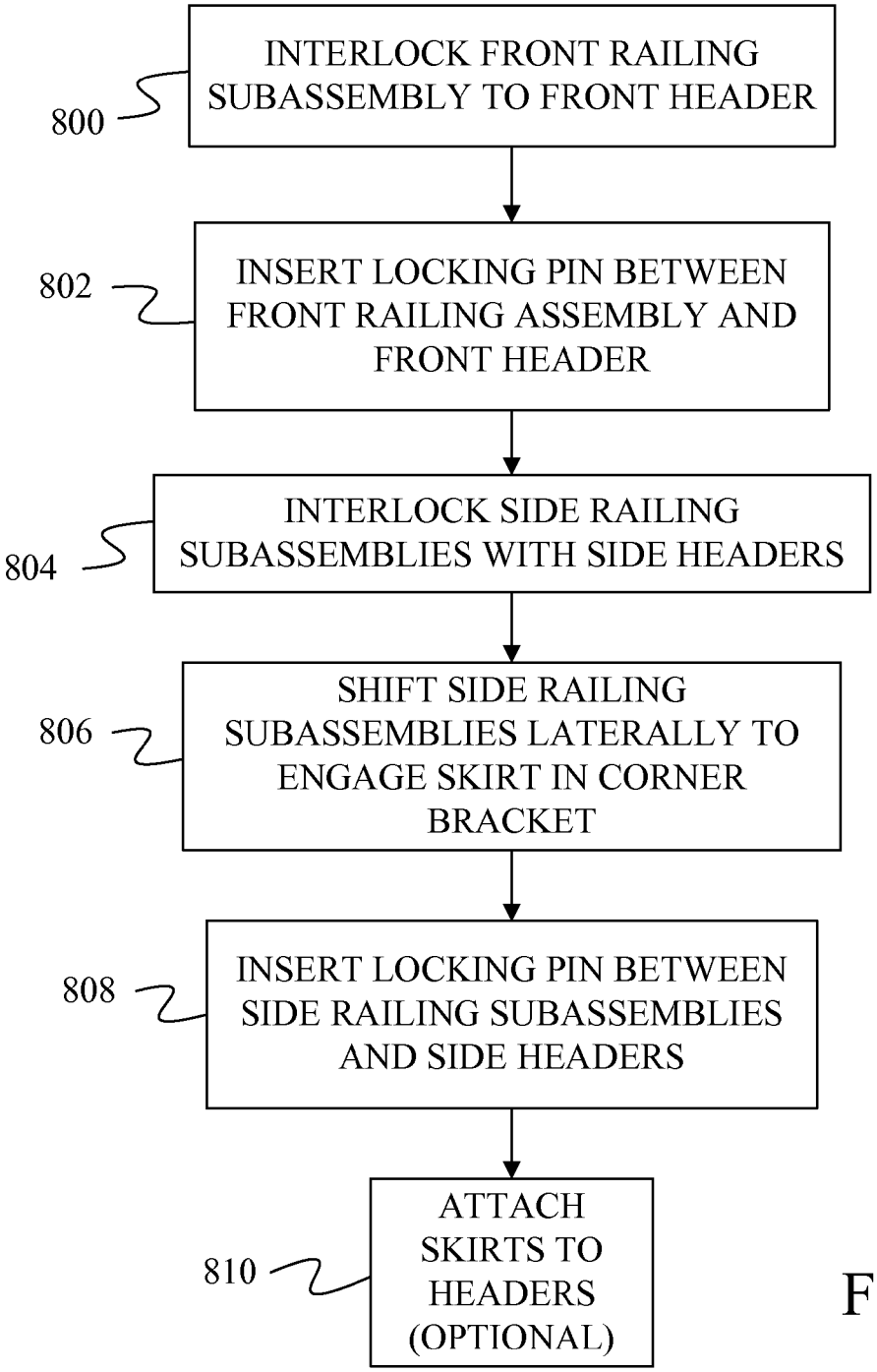
FIG. 8 is flow diagram of a method of attaching a railing system under one embodiment.

FIG. 8 provides a flow diagram of a method of attaching railing subassemblies to frames under one embodiment of the present invention. In step 800, a mounting member of a front railing subassembly is interlocked to a front header of a frame by inserting a tongue of the mounting member in a channel of the header while inserting a tongue of the header in a channel of the mounting member. In some embodiments, the step of interlocking further comprises inserting a second tongue of the mounting member in a second channel of the header. In step 802, a locking pin is inserted between the header and the mounting member to prevent vertical movement of the mounting member relative to the header. In step 804, mounting members of side railing subassemblies are interlocked with side headers and at step 806 the side railing subassemblies are laterally shifted to engage the skirts on the side railing subassemblies with the corner brackets on the front railing subassemblies. This limits lateral movement of the mounting members relative to the headers. At step 808, locking pins are inserted between the side railing subassemblies and the respective side headers. At optional step 810, the skirts of the railing subassemblies are attached to the respective headers.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A platform system comprising:

a platform frame comprising a header having a first tongue partially defining a first channel;

decking, mounted to the header;

a mounting member having a second tongue partially defining a second channel, wherein the mounting member and the header form an interlock coupling where the second tongue of the mounting member resides in the first channel of the header and the first tongue of the header resides in the second channel of the mounting member such that the mounting member is allowed to be shifted laterally relative to the header;

a pin, separate from and located between the header and the mounting member, wherein the pin limits vertical movement of the mounting member relative to the header; and a post attached to the mounting member.

2. The platform system of claim 1, wherein the header further comprises a bottom arm extending from a base portion of the header below the post, and a lip extending upward at an end of the bottom arm to form a channel below the post.

3. The platform system of claim 1, further comprising a skirt mounted to the post opposite the mounting member.

4. The platform system of claim 3, further comprising a corner bracket, mounted to the skirt such that a second skirt is frictionally held between the corner bracket and the post.

5. The platform system of claim 3, further comprising a locking mechanism connecting the header and the skirt.

6. The platform system of claim 1 wherein the header further comprises a third channel and wherein the mounting member further comprises a tongue extending into the third channel.

7. The platform system of claim 1 further comprising a plurality of posts attached to the mounting member.

8. The platform system of claim 7 further comprising a rail extending between at least two of the plurality of posts.

9. The platform system of claim 1 further comprising a second mounting member defining a third channel and wherein the platform frame further comprises a second header defining a fourth channel, wherein the second mounting member and the second header form an interlock coupling where a portion of the second mounting member resides in the fourth channel and a portion of the second header resides in the third channel.

10. A platform system comprising:

a platform frame comprising a header having a recess and having a first tongue partially defining a first channel;

a mounting member having a second recess and having a second tongue partially defining a second channel, wherein the mounting member and the header form an interlock coupling where the second tongue of the mounting member resides in the first channel of the header and the first tongue of the header resides in the second channel of the mounting member and wherein the first recess is aligned with the second recess, wherein the interlock coupling allows the mounting member to be laterally shifted relative to the header;

a locking mechanism separate from the header and the mounting member extending within both the first recess and the second recess and preventing the mounting member from moving vertically relative to the header; and a post attached to the mounting member.

11. The platform system of claim 10, wherein the first recess and the second recess together define a circular recess and wherein the locking mechanism comprises a circular pin inserted in the circular recess.

12. The platform system of claim 11, further comprising decking mounted to the header opposite the mounting member.

13. The platform system of claim 10, wherein the header further comprises a bottom arm extending from a base portion of the header below the post, and a lip extending upward at an end of the bottom arm to form a channel underneath the post.

14. The platform system of claim 10, further comprising a skirt mounted to the post opposite the mounting member.

15. The platform system of claim 14, further comprising a corner bracket, mounted to the skirt such that a second skirt is frictionally held between the corner bracket and the post.

16. The platform system of claim 14, further comprising a locking mechanism connecting the header and the skirt.

17. The platform system of claim 10 wherein the header further comprises a third channel and wherein the mounting member further comprises a tongue extending into the third channel.

18. The platform system of claim 10 further comprising a plurality of posts attached to the mounting member.

* * * * *